US010317054B1

(12) United States Patent
Davis et al.

(10) Patent No.: US 10,317,054 B1
(45) Date of Patent: Jun. 11, 2019

(54) LAMP RETENTION AND SHIELDING

(71) Applicants: Jared Michael Davis, Newnan, GA (US); Grzegorz Wronski, Peachtree City, GA (US); William Randolph Johnson, Jr., Peachtree City, GA (US)

(72) Inventors: Jared Michael Davis, Newnan, GA (US); Grzegorz Wronski, Peachtree City, GA (US); William Randolph Johnson, Jr., Peachtree City, GA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 489 days.

(21) Appl. No.: 15/002,197

(22) Filed: Jan. 20, 2016

(51) Int. Cl.

| | |
|---|---|
| ***F21V 7/00*** | (2006.01) |
| ***F21V 21/14*** | (2006.01) |
| ***F21V 14/02*** | (2006.01) |
| ***F21V 21/04*** | (2006.01) |
| ***F21S 8/02*** | (2006.01) |

(52) U.S. Cl.
CPC ..... *F21V 21/14* (2013.01); *F21S 8/026* (2013.01); *F21V 14/02* (2013.01); *F21V 21/047* (2013.01)

(58) Field of Classification Search
None
See application file for complete search history.

(56) References Cited

U.S. PATENT DOCUMENTS 8,096,670 B2 * 1/2012 Trott ..... F21S 8/02 362/147
2013/0294084 A1 * 11/2013 Kathawate ..... F21S 8/026 362/294

* cited by examiner

*Primary Examiner* — Elmito Breval
(74) *Attorney, Agent, or Firm* — King & Spalding LLP

(57) ABSTRACT

A lighting structure for a light fixture includes a trim ring, a spin ring positioned within the trim ring, and a tilt ring positioned within the spin ring and attached to the spin ring by a fastener. The tilt ring is tiltable relative to the spin ring. A first tab and a second tab extend inwardly from a wall of the tilt ring. The first tab and the second tab are positioned across from the fastener. The lighting structure further includes a lamp spring attached to the tilt ring across from the first tab and the second tab. The lamp spring is positioned to push a lamp toward the first tab and the second tab.

20 Claims, 10 Drawing Sheets

LAMP RETENTION AND SHIELDING

TECHNICAL FIELD

The present disclosure relates generally to lighting fixtures, and more particularly to retention of a lamp of a light fixture with an adjustable lighting structure and visual shielding of an area behind the lamp.

BACKGROUND

Some light fixtures, such as recessed light fixtures, may include an adjustable trim. An adjustable trim may allow rotation as well as tilting of a lamp (e.g., a PAR lamp) of the light fixture. To illustrate, rotation and/or tilting of the lamp of a recessed light fixture may be performed by pushing on the lamp from below the light fixture. For example, a lamp may be tilted in a particular direction by pushing upward, from below the light fixture, on a bottom surface of the lamp on one side of a pivot axis of the adjustable trim. However, exerting a force on the lamp to rotate or tilt the lamp may result in the lamp detaching from a lamp retention structure of the adjustable trim or otherwise cause the lamp to move to an undesired position relative to the adjustable trim. Removal of at least a portion of the trim may be required to reattach and/or to reposition the lamp to a desired position. Further, some adjustable trims that are tiltable (e.g., some non-spherical recessed gimbal trims) may allow people to view the inside of the recessed light fixture housing from below a ceiling when the adjustable trim is tilted.

Thus, a lighting structure such as an adjustable structure that reduces the chance of a lamp detaching from the lighting structure or moving to an undesirable position relative to the lighting structure may be desirable.

SUMMARY

The present disclosure relates generally to retention of a lamp of a light fixture with an adjustable lighting structure and visual shielding of an area behind the lamp. In an example embodiment, a lighting structure for a light fixture includes a trim ring, a spin ring positioned within the trim ring, and a tilt ring positioned within the spin ring and attached to the spin ring by a fastener. The tilt ring is tiltable relative to the spin ring. A first tab and a second tab extend inwardly from a wall of the tilt ring. The first tab and the second tab are positioned across from the fastener. The lighting structure further includes a lamp spring attached to the tilt ring across from the first tab and the second tab. The lamp spring is positioned to push a lamp toward the first tab and the second tab.

In another example embodiment, a light fixture includes a housing and a lighting structure positioned in the housing. The lighting structure includes a spin ring and a tilt ring. The tilt ring is positioned within the spin ring and attached to the spin ring by a fastener. The tilt ring is tiltable relative to the spin ring. A first tab and a second tab extend inwardly from a wall of the tilt ring. The first tab and the second tab are positioned across from the fastener. The lighting structure further includes a lamp spring attached to the tilt ring across from the first tab and the second tab. The light fixture also includes a lamp extending through the tilt ring. The lamp spring is positioned to push the lamp toward the first tab and the second tab.

In another example embodiment, a lighting structure for a light fixture includes a trim ring, a spin ring positioned within the trim ring, and a tilt ring positioned within the spin ring and attached to the spin ring by a fastener. The tilt ring is tiltable relative to the spin ring. The lighting structure further includes a tape attached to an inner surface of the tilt ring across from the fastener. The lighting structure also includes a lamp spring attached to the tilt ring across from the tape. The lamp spring is positioned to push a lamp toward the tape.

In another example embodiment, a lighting structure includes a trim ring and a spin ring positioned within the trim ring. The lighting structure further includes a tilt ring positioned within the spin ring and attached to the spin ring by a first fastener and a second fastener. The first fastener and the second fastener are across from each other. The tilt ring has a first elevated section and a second elevated section that are between the first fastener and the second fastener and across from each other. The tilt ring includes lower sections between the first elevated section and the second elevated section. The first elevated section and the second elevated section extend higher than the lower sections. The first elevated section and the second elevated section each comprise an inwardly curved section.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1A:
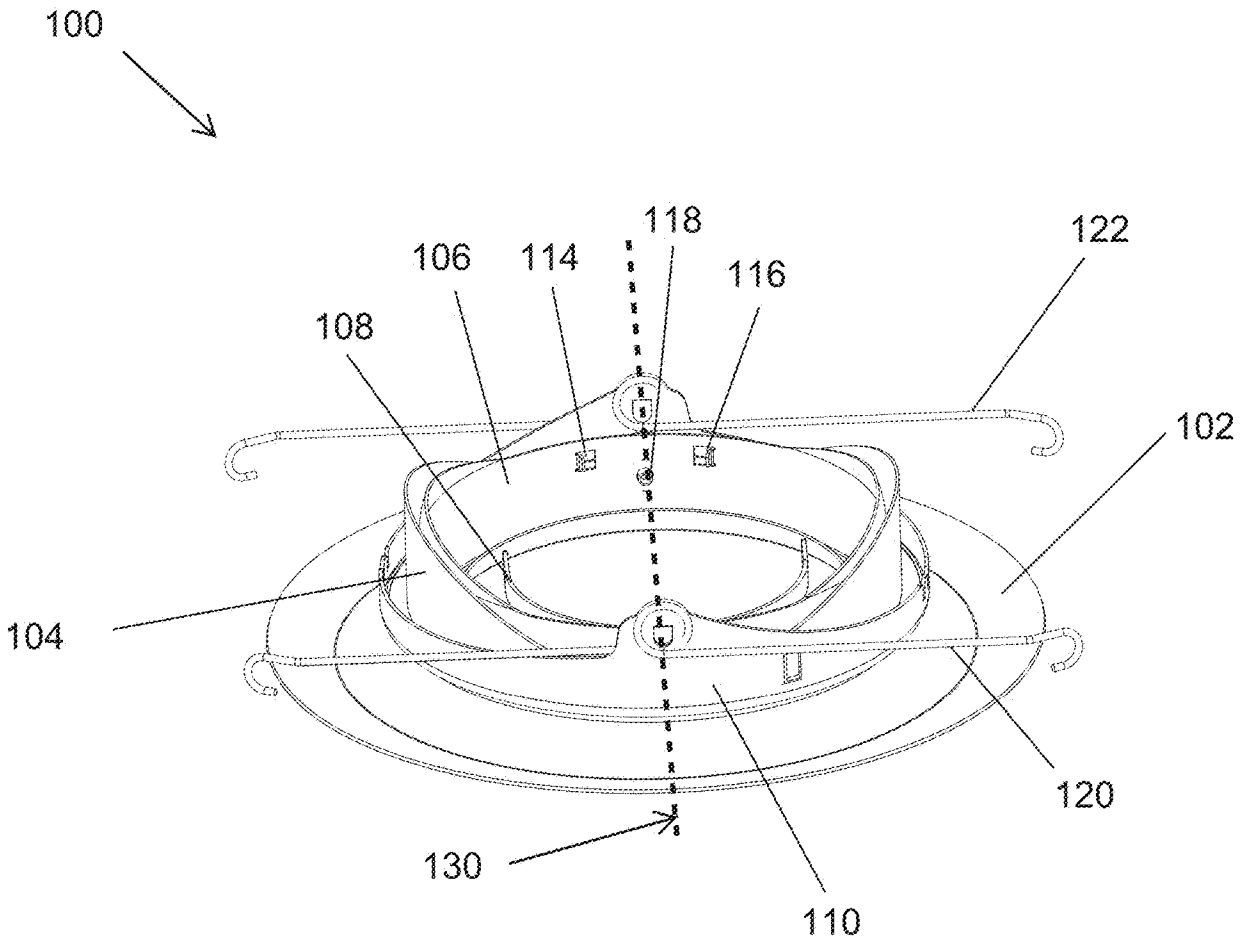
FIGS. 1A and 1B illustrate side perspective views of a lighting structure for a light fixture according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Figure 1B:
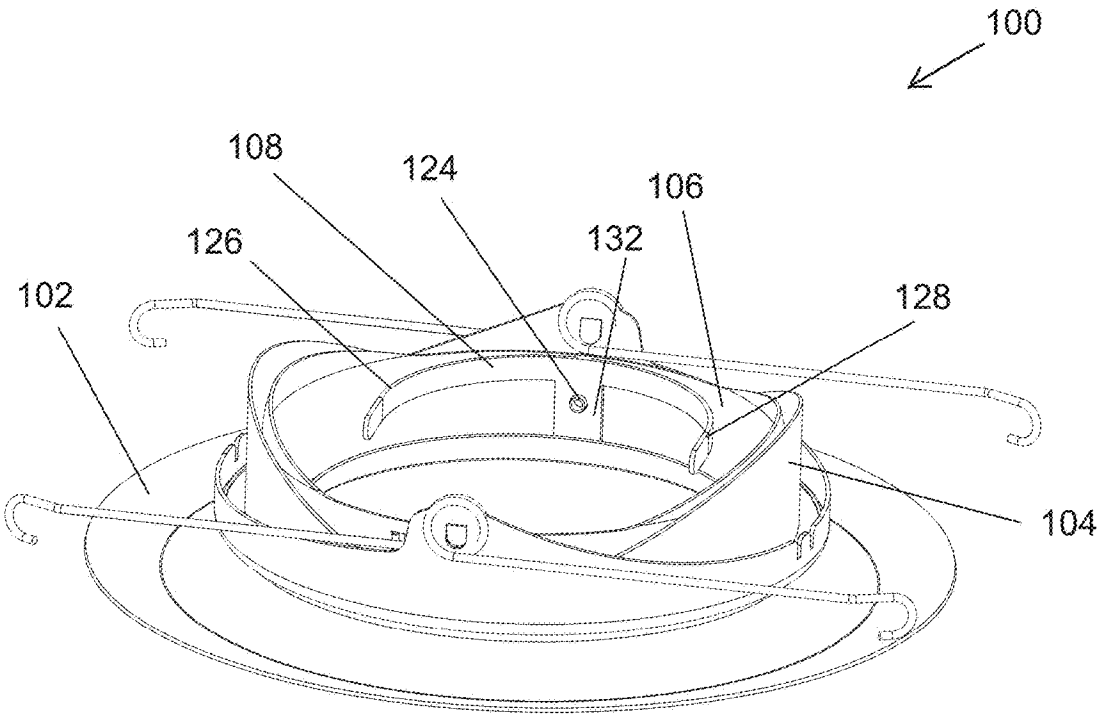

Turning now to the drawings, FIGS. 1A and 1B illustrate side perspective views of a lighting structure 100 for a light fixture according to an example embodiment. As illustrated in FIGS. 1A and 1B, the lighting structure 100 may include a trim ring 102, a spin ring 104, and a tilt ring 106. The lighting structure 100 may also include a lamp spring 108. The tilt ring 106 may be attached to the spin ring 104, and the lamp spring 108 may be attached to the tilt ring 106. In some example embodiments, the lighting structure 100 may include torsion springs 120, 122 that are attached to the trim ring 102.

In some example embodiments, the spin ring 104 is positioned within the trim ring 102 and may be rotatable with respect to the trim ring 102. To illustrate, the spin ring 104 may rest on a ledge portion of the trim ring 102. For example, the spin ring 104 may be rotatable 360 degrees relative to the trim ring 102. Alternatively, the spin ring 104 may be rotatable slightly less than 360 degrees relative to the trim ring 102. For example, the spin ring 104 may be rotatable approximately 359 degrees. In some alternative embodiments, the spin ring 104 may be rotatable significantly less than 360 degrees relative to the trim ring 102.

In some example embodiments, the tilt ring 106 may be positioned with the spin ring 104. The tilt ring 106 may be attached to the spin ring 104 by a fastener 118. The tilt ring 106 may also be attached to the spin ring by another fastener 124 (more clearly shown in FIG. 1B) that is across from the fastener 118. To illustrate, the tilt ring 106 may be attached to the spin ring 104 such that the tilt ring 106 is rotatable along with the spin ring 104. The fasteners 118, 124 form a pivot axis 130 such that sections of the tilt ring 106 that are on opposite sides of the pivot axis 130 move in opposite directions when the tilt ring 106 is being tilted. The fasteners 118, 124 may each be rivets or other types of fasteners that allow the tilt ring 106 to tilt relative to the spin ring 104 as may be contemplated by those of ordinary skill in the art without departing from the scope of this disclosure.

In some example embodiments, the lamp spring 108 is positioned within the tilt ring 106. The lamp spring 108 may be attached to the tilt ring 106 by the fastener 124 as shown in FIG. 1B. Alternatively, the lamp spring 108 may be attached to the tilt ring 106 by another fastener.

In some example embodiments, the lamp spring 108 may include arms 126, 128. For example, the arms 126, 128 may extend away from the fastener 124. The arms 126, 128 may be spaced from each other such that the arms 126, 128 can hold a lamp in the space between them. Relative to the fastener 124, the arms 126, 128 may initially extent away from each other and curve toward the opposite side of the tilt ring 106. To illustrate, the arms 126, 128 may form a U-shaped spring. The arms 126, 128 may be elastic such that each arm 126, 128 exerts a counteracting force when pushed outwardly.

In some example embodiments, the lamp spring 108 includes an attachment tab 132 that extends downward from the arms 126, 128. For example, the fastener 124 may extend through the attachment tab 132 to attach the lamp spring 108 to the tilt ring 106. Alternatively, the attachment tab 132 may be omitted. For example, the fastener 124 may extend through the spring at a different location to attach the lamp spring 108 to the tilt ring 106.

In some example embodiments, the lighting structure 100 may include retention tabs 114, 116 (more clearly shown in FIG. 1A) that extend inwardly from a wall of the tilt ring 106. The retention tabs 114, 116 may be positioned on the tilt ring 106 generally across from the fastener 124. To illustrate, the lamp spring 108 may be positioned across from the retention tabs 114, 116 such that the lamp spring 108 pushes a lamp that is attached to the lamp spring 108 toward the retention tabs 114, 116.

To illustrate, the retention tabs 114, 116 may be positioned to resist an upward movement of a lamp (e.g., a PAR lamp) when the lamp comes in contact with the retention tabs 114, 116 during an upward movement of the lamp. For example, an upward movement of a lamp that is held by the lamp spring 108 may be caused by a person pushing upward on the lamp to change the tilt angle of the lamp. During an upward movement of a lamp (e.g., a PAR lamp), the lamp may stretch out the arms 126, 128 of the lamp spring 108 such that the lamp spring 108 resist movement of the lamp away from the retention tabs 114, 116. For example, the arms 126, 128 may push the lamp toward the retention tabs 114, 116 as the lamp moves upward. Depending on a tilt angle of the lamp and tilt ring 106, one or both retention tabs 114, 116 may come in contact with the lamp and prevent further upward movement of the lamp, preventing the detachment of the lamp from the lamp spring 108. The arms 126, 128 of the lamp spring 108 also serve to retain the lamp in position relative to the tilt ring 106.

In some example embodiments, the retention tabs 114, 116 may be formed from sections of the wall of the tilt ring 106. For example, the retention tabs 114, 116 may be bent inward after cutting through the wall of tilt ring 106 such that the retention tabs 114, 116 remain attached to the wall on one side of the retention tabs 114, 116. In some alternative embodiments, the retention tabs 114, 116 may be welded onto the wall of the tilt ring 106.

Although two retention tabs 114, 116 are shown in FIG. 1A, in some alternative embodiments, the lighting structure 100 may include a single retention tab. For example, a single retention tab that horizontally extends between the positions of the retention tabs 114, 116 may be used. In some alternative embodiments, the retention tabs 114, 116 may each have a broad surface that is facing downward. In some alternative embodiments, the retention tabs 114, 116 may each be curved at the end distal from the wall of the tilt ring 106. Although the retention tabs 114, 116 are shown as having a rectangular shape, in alternative embodiments, the retention tabs 114, 116 may have other shapes without departing from the scope of this disclosure.

In some example embodiments, the trim ring 102 includes a wall section 110 that extends generally upward. For example, the wall section may include torsion spring attachment structures for attaching the torsion springs 120, 122 to the trim ring 102. The torsion springs 120, 122 may be used to attach the lighting structure 100 to a light fixture housing.

The trim ring 102, the spin ring 104, and the tilt ring 106, and the lamp spring 108 may each be made from a suitable material that may be contemplated by those of ordinary skill in the art with the benefit of this disclosure. For example, the trim ring 102 may be made from plastic or another suitable material. The trim ring 102 may be made using a method such as stamping. The trim ring 102 may also be made from a die cast material. The spin ring 104, the tilt ring 106, and the lamp spring 108 may also be made from similar materials using one or more methods such as stamping, injection molding and die casting. In general, the spin ring 104, the tilt ring 106, and the lamp spring 108 may be made, for example, from die casted metal or sheet metal.

Because the retention tabs 114, 116 working in conjunction with the lamp spring 108 prevent a lamp such as a PAR lamp held by the lamp spring 108 from move upward after coming in contact with one or both of the retention tabs 114, 116, the lamp remains securely retained to the lighting structure 100. Further, because the lamp spring 108 is attached to the tilt ring 106 by the fastener 124 forming a pivot point of the pivot axis 130 and because the retention tabs 114, 116 are positioned close to the pivot axis 130, the lamp spring 108 and the retention tabs 114, 116 are generally hidden from view from below the lighting structure 100.

Figure 2:
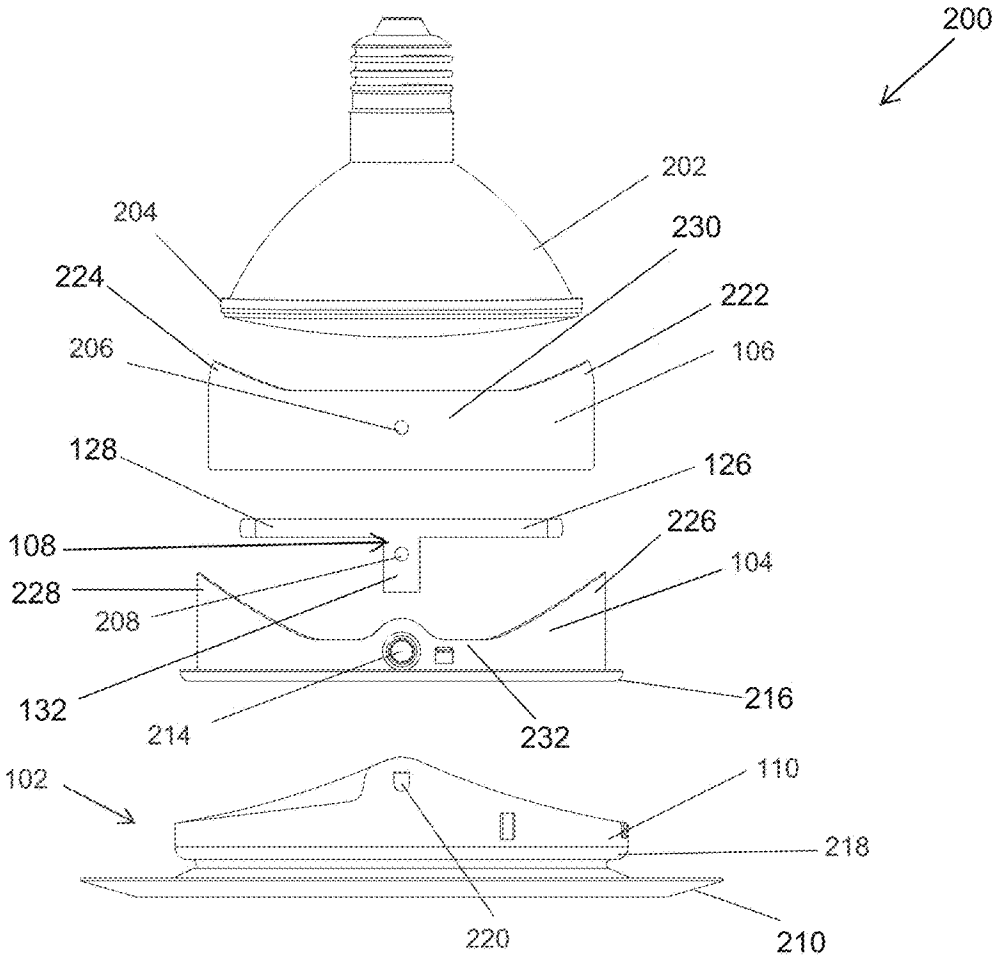
FIG. 2 illustrates an exploded view of a lighting structure including a lamp and the lighting structure of FIGS. 1A and 1B according to an example embodiment.
Figure 3:
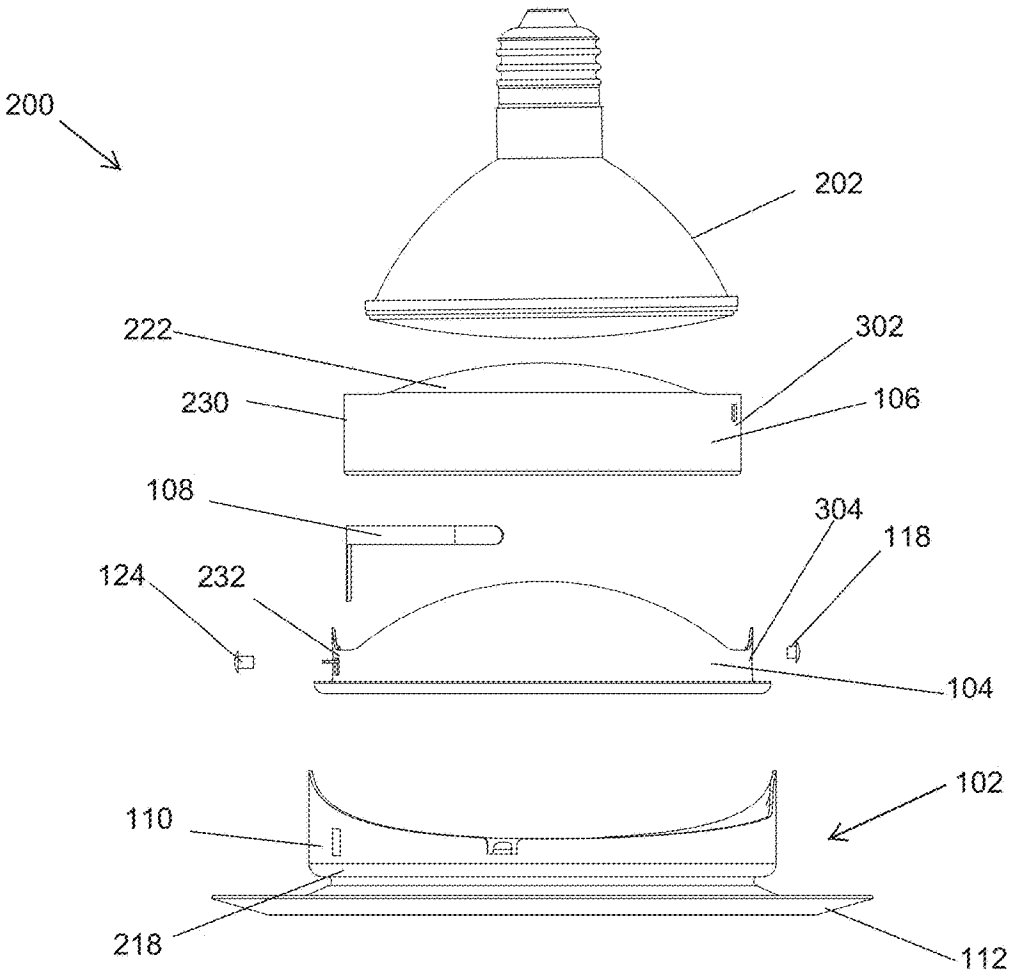
FIG. 3 illustrates another exploded view of the lighting structure of FIG. 2 according to an example embodiment.

FIG. 2 illustrates an exploded view of a lighting structure 200 including a lamp 202 and the lighting structure 100 of FIGS. 1A and 1B according to an example embodiment. FIG. 3 illustrates another exploded view of the lighting structure 200 of FIG. 2 according to an example embodiment. As illustrated in FIGS. 2 and 3, the lighting structure 200 includes the lamp 202. For example, the lamp 202 may be a PAR lamp. In some example embodiments, the lamp 202 may include a lip 204 that extends around the lamp proximal to a bottom end of the lamp 202. Alternatively, the lip 204 may be omitted from the lamp 202.

In some example embodiments, the tilt ring 106 includes a hole 206 for attaching the lamp spring 108 to the tilt ring 106 using a fastener such as the fastener 124 shown in FIG. 1B. The hole 206 may also be used to attach the tilt ring 106 to the spin ring 104 using the fastener 124. The tilt ring 106 may also include a corresponding hole extending through the wall of the tilt ring 106 across from the hole 206.

In some example embodiments, the tilt ring 106 may include elevated sections 222, 224 that are between the hole 206 and the corresponding hole. The tilt ring 106 may also include a lower section 230 and a corresponding lower section 302 across from the lower section 230 that are between the elevated sections 222, 224. For example, the elevated sections 222, 224 may each include an extended blocking section such that the elevated sections 222, 224 extend higher than the lower sections 230, 302 when the tilt ring 106 is in an untilted position shown in FIGS. 2 and 3.

In some example embodiments, the elevated sections 222, 224 may gradually increase in height. For example, the elevated sections 222, 224 may have the largest height distal from the both the hole 206 and the corresponding hole across from the hole 206. Alternatively, the elevated sections 222, 224 may each have shapes other than shown in FIGS. 2 and 3. For example, each of the elevated sections 222, 224 may have a rectangular shape extending higher than the lower sections 230, 302.

In some example embodiments, the elevated sections 222, 224 may be curved inward proximal to the top edge of the elevated sections 222, 224. For example, the extended blocking section of the elevated sections 222, 224 may be curved inward. The inward curving of the elevated sections 222, 224 proximal to the top edge of the elevated sections 222, 224 allows the tilt ring 106 to have the elevated sections 222, 224 that extend higher than the lower sections 230, 302 while still being able to tilt relative to the spin ring 104. Alternatively, the extended blocking section of the elevated sections 222, 224 directed inward (e.g., bent or angled inward toward the center of the tilt ring 106) instead of being curved inward. In some example embodiments, the tilt ring 106 may be able to tilt up to approximately 40 degrees on both sides of the pivot axis 130 shown in FIG. 1A.

As illustrated in FIGS. 2 and 3, the lamp spring 108 includes the arms 126, 128. The lamp spring 108 may also include a hole 208 formed through the attachment tab 132. The hole 208 may be used to attach the lamp spring 108 to the tilt ring 106 using the fastener 124 or another similar fastener. In some example embodiments, the fastener 124 may securely attach the lamp spring 108 to the tilt ring 106 through the hole 208 such that the lamp spring 108 is tiltable along with the tilt ring 106.

In some example embodiments, the spin ring 104 includes a hole 214 and a corresponding hole across from the hole 214. The hole 214 and the corresponding hole may be used to attach the tilt ring 106 to the spin ring 104 using fasteners such as the fasteners 118, 124. In some example embodiments, the holes 206, 208, 214 may be aligned such that the fastener 124 may be used to attach the lamp spring 108, the tilt ring 106, and the spin ring 104 together.

Figure 4A:
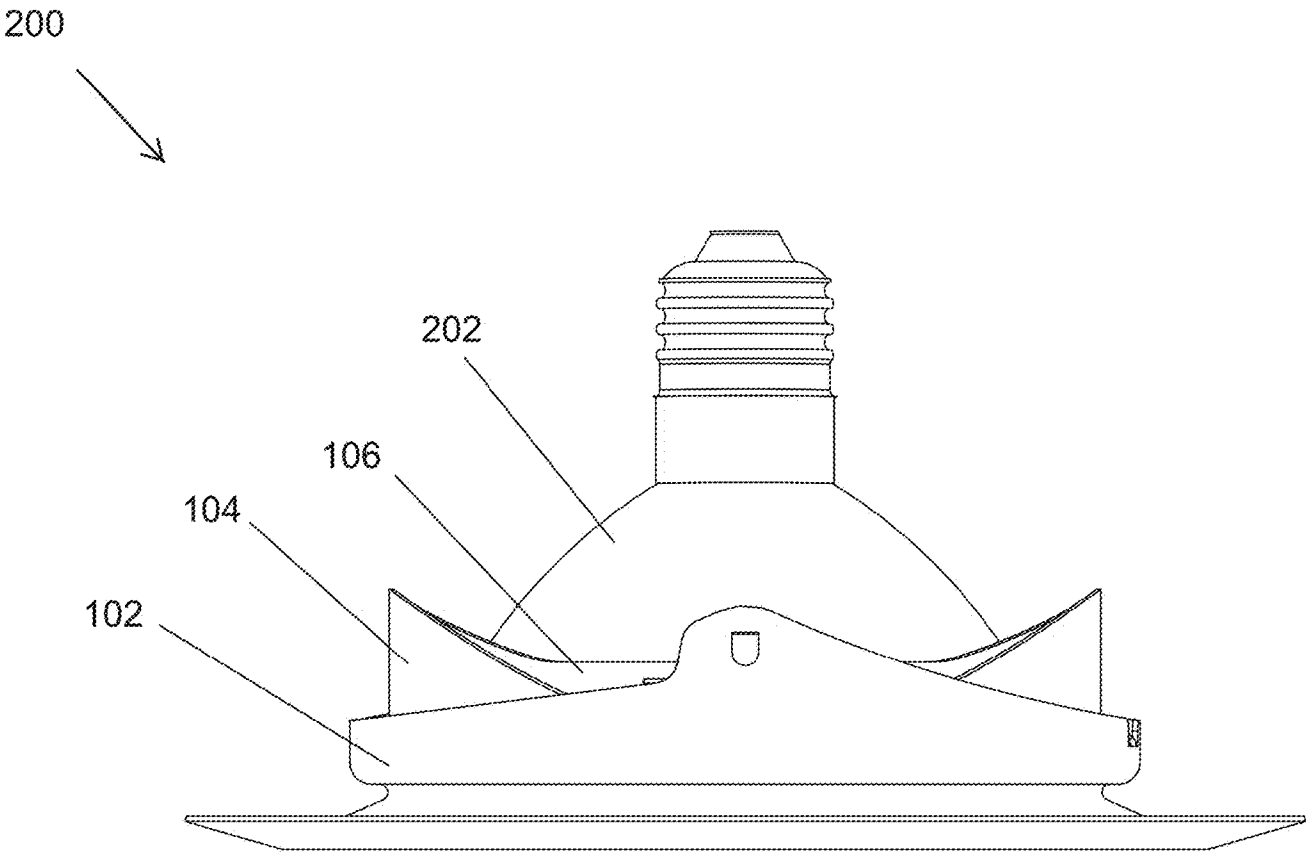
FIG. 4A illustrates a side view of the lighting structure 200 FIG. 2 in an untilted position according to an example embodiment.

In some example embodiments, the spin ring 104 includes tall sections 226, 228. For example, when the lighting structure 200 is assembled (for example, as shown in FIG. 4A), the tall section 226 of the spin ring 104 may be adjacent to the elevated section 222 of the tilt ring 106, and the tall section 228 of the spin ring 104 may be adjacent to the elevated section 224 of the tilt ring 106. The spin ring 104 may also include short sections 232, 304. The tall sections 226, 228 may extend higher than short sections 232, 304.

In some example embodiments, the tall sections 226, 228 may gradually increase in height. For example, the tall sections 226, 228 may have the largest height distal from the both the hole 214 and the corresponding hole through the spin ring 104 across from the hole 214. Alternatively, the tall sections 226, 228 may each have shapes other than shown in FIGS. 2 and 3. For example, each of the tall sections 226, 228 may have a rectangular shape extending higher than the short sections 232, 304. In some example embodiments, the short sections 232, 304 may be omitted, and the entire spin ring 104 may have the height of the tall sections 226, 228.

In some example embodiments, the trim ring 102 may have the wall section 110, a flange section 210, and a ledge section that is between the wall section 110 and the flange section 210. The trim ring 102 may include torsion spring attachment tabs such as the tab 220 for attaching torsions springs 120, 122 shown in FIG. 1A. The spin ring 104 may include a bottom section 216 that is shaped to rest on the ledge portion of the trim ring 102 within the trim ring 102. Upward movement of the spin ring 104 relative to the trim ring 102 may be limited by one or more means as may be contemplated by those of ordinary skill in the art with the benefit of this disclosure. For example, one or more tabs of the tilt ring 106 may be bent over an upper edge of the bottom section 216 to limit the upward movement of the spin ring 104.

Figure 4B:
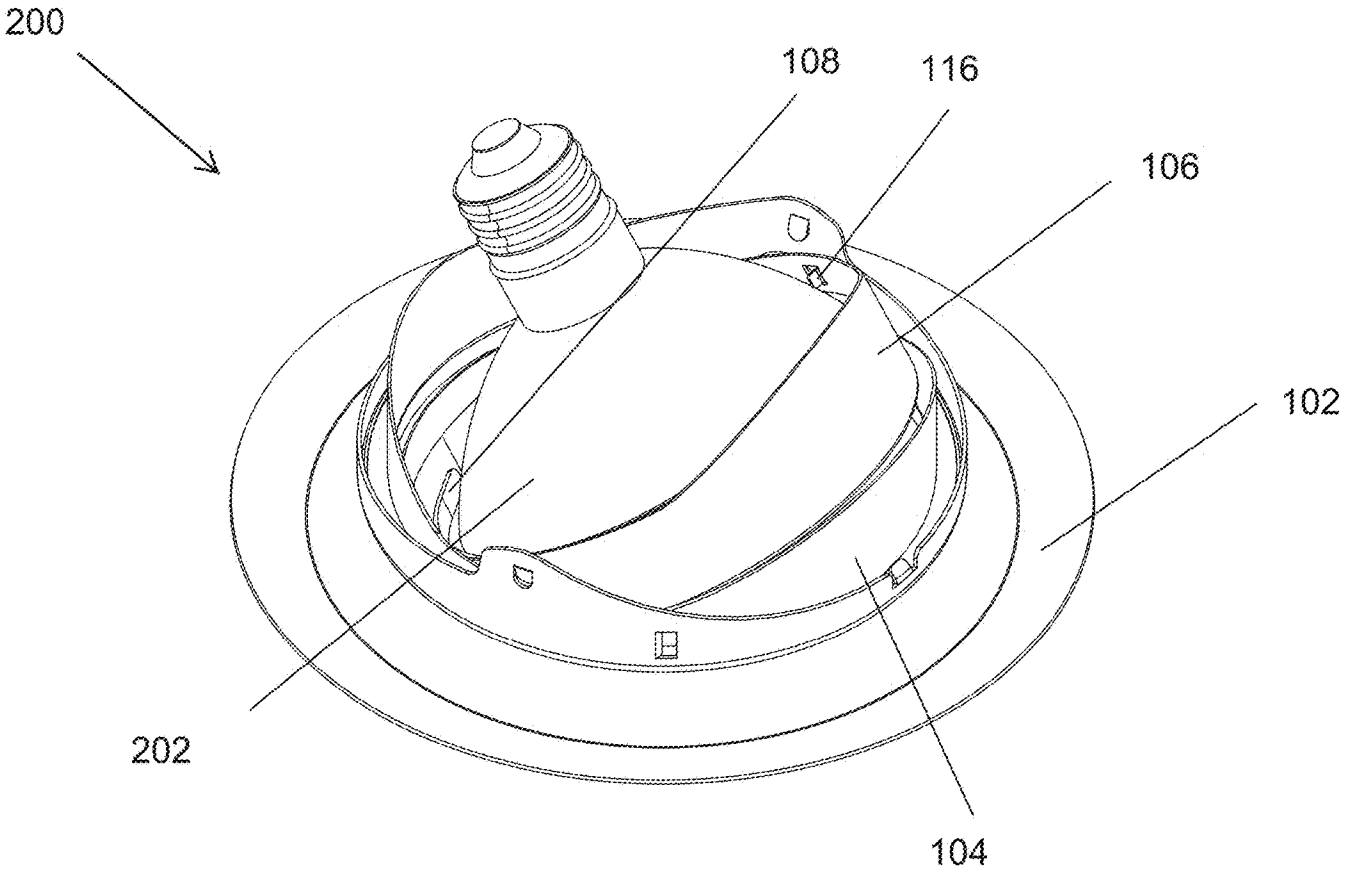
FIG. 4B illustrates a top perspective view of the lighting structure of FIG. 4A in a tilted position according to an example embodiment.

FIG. 4A illustrates a side view of the lighting structure 200 FIG. 2 in an untilted position according to an example embodiment. FIG. 4B illustrates a top perspective view of the lighting structure 200 of FIG. 4A in a tilted position according to an example embodiment. As illustrated in FIGS. 4A and 4B, the spin ring 104 is positioned within the trim ring 102, and the tilt ring 106 is positioned within the spin ring 104. The tilt ring 106 along with the lamp 202 may be tilted to the right and left of the position of the tilt ring 106 and the lamp 202 shown in FIG. 4A. For example, in FIG. 4B, the tilt ring 106 is shown tilted relative to the spin ring 104. The lamp 202 which is retained by the lamp spring 108 is tilted along with the tilt ring 106. To illustrate, the tilt ring 106 and the lamp 202 may be tilted to the position shown in FIG. 4B or to another position by push upward on the lamp 202 from below the lighting structure 200 to rotate the tilt ring 106 and lamp along the pivot axis 130 shown in FIG. 1A.

As shown in FIG. 4B, the lamp spring 108 holds the lamp 202. The retention tab 116 is positioned to resist an upward movement of the lamp 202 once the lamp 202 comes in contact with the retention tab 116. By resisting further upward movement of the lamp 202, the retention tab 116 may prevent the lamp 202 from popping upward through the lamp spring 108. Thus, by preventing the lamp 202 from detaching from lamp spring 108 upward, removal of the trim ring 102 from a ceiling to reattach the lamp to the lamp spring 108 may be avoided. In some example embodiments, the tilt ring 106 along with the lamp 202 may be tilted up to approximately 40 degrees on both sides of the pivot axis 130 shown in FIG. 1A.

Figure 5:
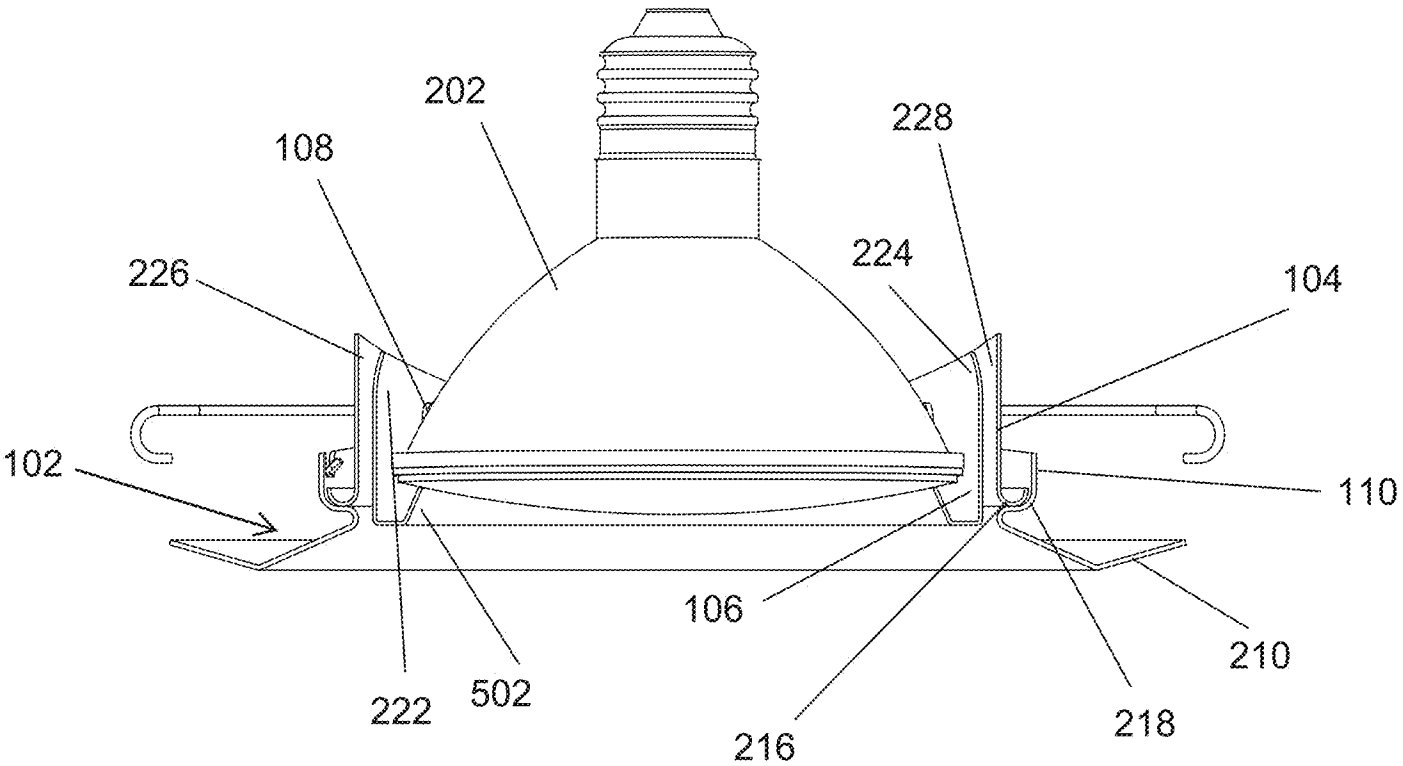
FIG. 5 illustrates a cross-sectional view of the lighting structure of FIG. 4A according to an example embodiment.

FIG. 5 illustrates a cross-sectional view of the lighting structure 200 of FIG. 4A according to an example embodiment. As illustrated in FIG. 5, the lamp 202 rests on a rim 502 of the tilt ring 106. The arms of the lamp spring 108 are position around the lamp 202. The elevated section 222 of the tilt ring 106 is adjacent to the tall section 226 of the spin ring 104, and the elevated section 224 of the tilt ring 106 is adjacent to the tall section 228 of the spin ring 104. The elevated section 222 is curved inward at the top edge of the elevated section 222, and the elevated section 224 is curved inward at the top edge of the elevated section 224.

In some example embodiments, the spin ring 104 is positioned on the ledge section 218 of the trim ring 102 that is between the wall section 110 and the flange section 210 of the trim ring 102. For example, the bottom section 216 of the spin ring 104 may be positioned on the ledge section 218 such that the spin ring 104 can rotate relative to the trim ring 102. The flange section 210 of the trim ring 102 is designed to be positioned below a ceiling when the lighting structure 200 is recessed behind the ceiling. When the lamp 202 is pushed upward from below the lighting structure 200, the arms of the lamp spring 108 are pushed outward by the lamp, resulting in a counteracting force. When the lamp 202 moves upward such that the lamp 202 comes in contact with one or both retention tabs 114, 116 shown in FIG. 1A, one or both of the retentions tabs 2 in conjunction with the lamp spring 108 may prevent the lamp 202 from detaching upward from the lamp spring 108 and the tilt ring 106.

Figure 6:
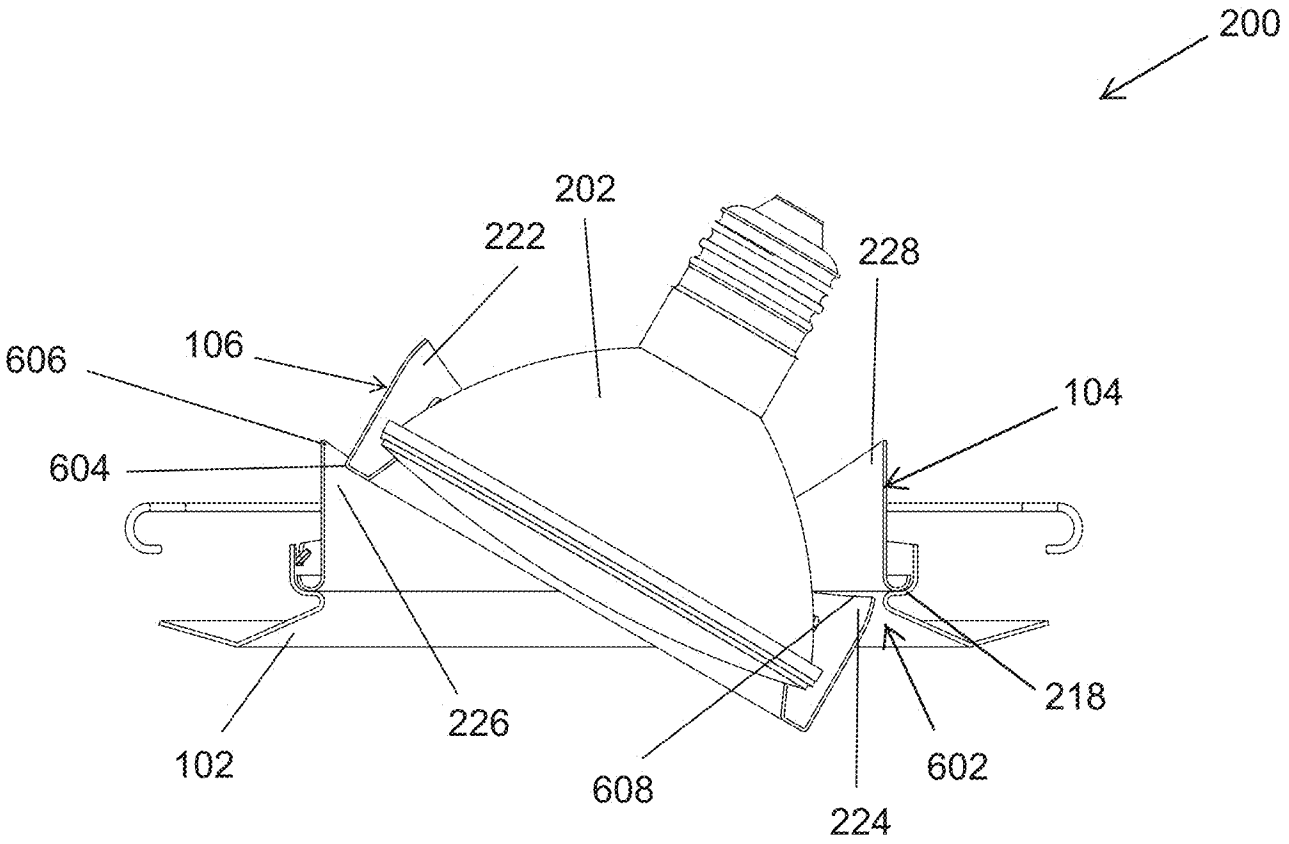
FIG. 6 illustrates a cross-sectional view of the lighting structure of FIG. 4A with the lamp in a tilted position according to an example embodiment.

FIG. 6 illustrates a cross-sectional view of the lighting structure of FIG. 4A with the lamp 202 in a tilted position according to an example embodiment. As illustrated in FIG. 6, the bottom edge 604 of the tilt ring 106 remains below a top edge 606 of the tall section 226 when the tilt ring 106 and the lamp 202 are fully tilted in a first direction, eliminating a gap that normally exists between spin rings and trim rings of typical lighting structures when the tilt rings are tilted beyond certain angles that are less than the maximum tilt angles of the tilt rings. The relative positions of the bottom edge 602 of the tilt ring 106 and the top edge 606 of the tall section 226 of the spin ring 104 limits the view into the back of the lighting structure 200 from under the lighting structure 200.

In some example embodiments, the top edge 608 of the elevated section 224 of the tilt ring 106 is generally aligned with a bottom end of the bottom section 218 of the spin ring 104, which leaves a small gap 602 between the top edge 608 and the spin ring 104. Because the elevated section 224 and the tall section 228 extend higher than corresponding sections of tilt rings and spin rings that are used in typical lighting structures, the view into the back of the lighting structure 200 through the gap 602 from under the lighting structure 200 is limited. Because the elevated section 224 is curved inward proximal to the top edge 608, the tilt ring 106 may be tilted up to typical tilt angles such as 40 degrees. When the tilt ring 106 and the lamp 202 are tilted in the opposite direction, the tilt ring and the spin ring 104 function in a similar manner as described with respect to FIG. 6 to limit view into the back side of the lighting structure 200, such as into the recessed housing of a light fixture that includes the lighting structure 200.

Figure 7:
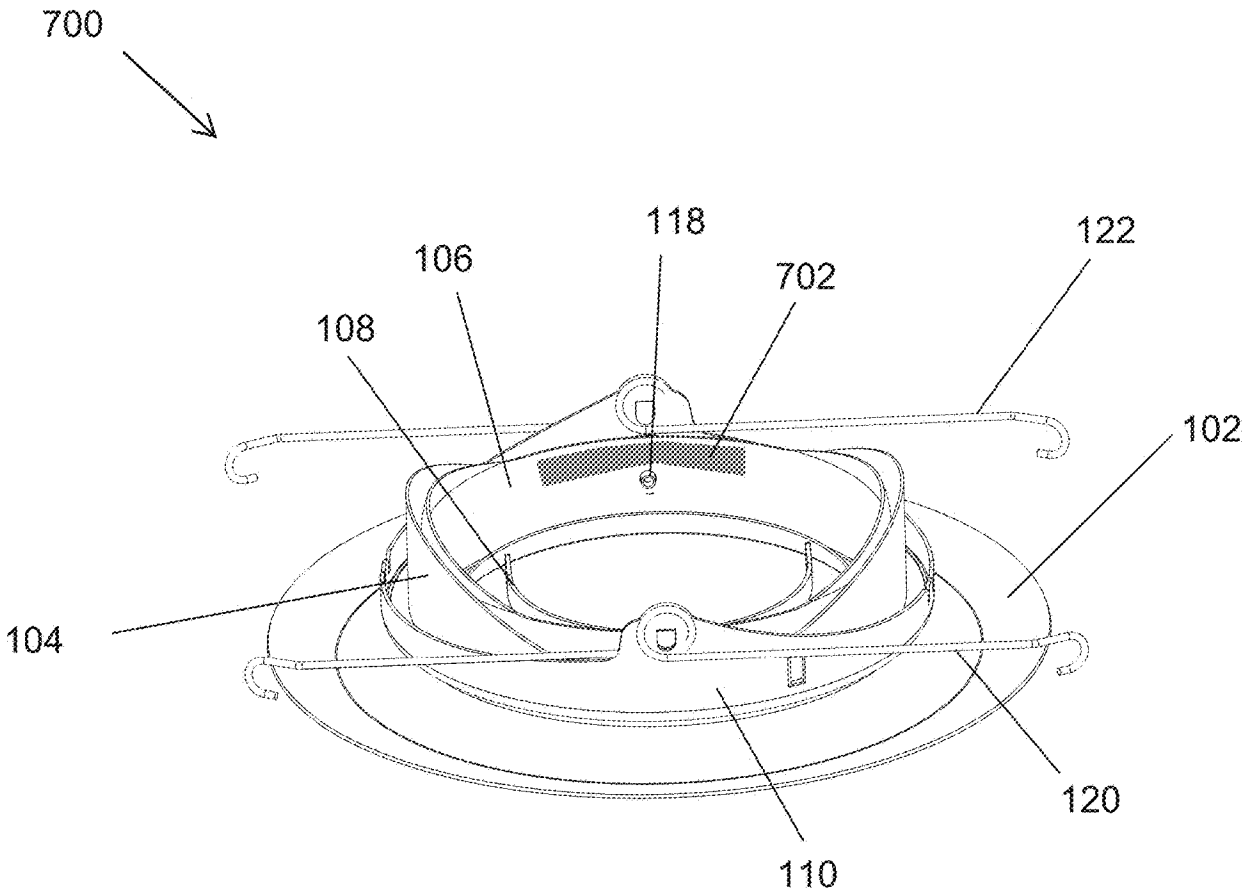
FIG. 7 illustrates a side perspective view of a lighting structure for a light fixture according to another example embodiment.

FIG. 7 illustrates a side perspective view of a lighting structure 700 for a light fixture according to another example embodiment. The lighting structure 700 is substantially the same as the lighting structure 100. As illustrated in FIG. 7, the lighting structure 700 includes a tape 702 instead of the retention tabs 114, 116 shown in FIG. 1A. In general, the tape 702 is positioned to resist an upward movement of a lamp, such as the lamp 202 shown in FIG. 2, during adjustment of the tilt ring 106 and the lamp to adjust the tilt angle of the lamp.

As illustrated in FIG. 7, the lighting structure 700 includes the trim ring 102, the spin ring 104, and the tilt ring 106 positioned within the spin ring 104. The lamp spring 108 is attached to the tilt ring 106 as describe above across from the tape 702. The tape 702 may be a silicon tape. Alternatively, the tape 702 may be made from foam that is attached to the inner surface of the tilt ring 106. For example, the tape 702 may be attached to the tilt ring 106 using a heat resistant adhesive or other means as may be contemplated by those of ordinary skill in the art with the benefit of this disclosure.

To illustrate, when a lamp that is attached to the lamp spring 108 is pushed upward from below the lighting structure 700 to adjust the tilt angle of the lamp, the tape 702 in conjunction with the lamp spring 108 resist the upward detachment of the lamp from the lamp spring 108. To illustrate, once a portion of the lamp (e.g., the lip 204 shown in FIG. 2) comes in contact with the tape 702, the tape 702 may resist further movement through friction between the tape 702 and the portion of the lamp, which may prevent upward detachment of lamp and avoid removal of the trim ring 102 from a ceiling after the lighting structure 700 is installed.

Figure 8:
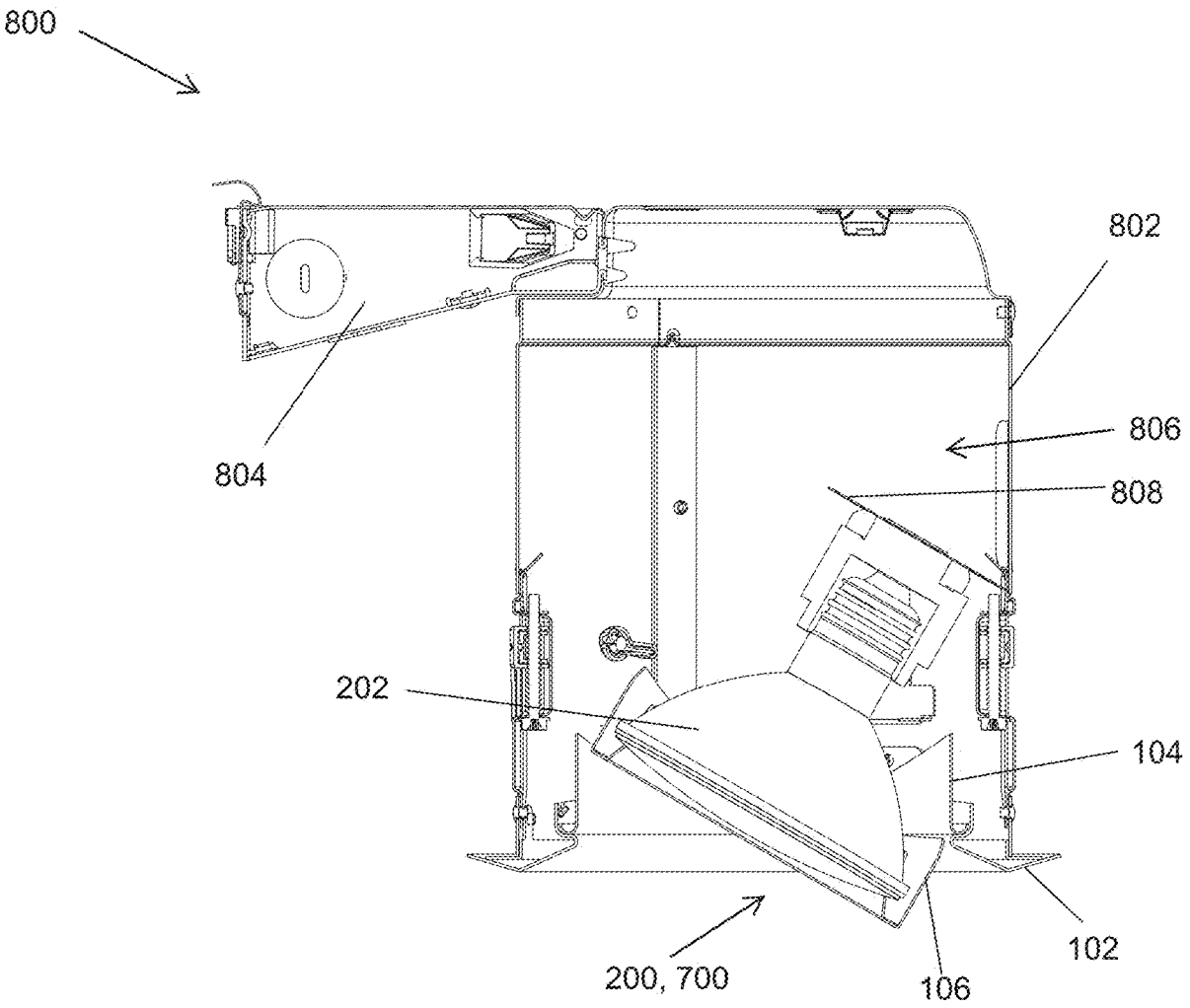
FIG. 8 illustrates a cross-sectional view of a lighting fixture including a lighting structure according to an example embodiment.

FIG. 8 illustrates a cross-sectional view of a lighting fixture 800 including the lighting structure 200, 700 according to an example embodiment. As illustrated in FIG. 8, the lighting fixture 800 includes a housing 806 and a junction box 804. The junction box 804 may be used to make wiring connections and/or store electrical components used to provide power to the lamp 202.

The lighting structure 200, 700 is positioned in a cavity 806 of the housing 802. A portion of the trim ring 102 (i.e., the flange section 210 shown in FIG. 2) may be positioned below the housing 802 such that the portion of the trim ring 102 is below a ceiling when the housing 802 is recessed in the ceiling.

In some example embodiments, a socket assembly 808 or another structure may come in contact with the housing 802 to limit tiling of the lamp 202 and the tilt ring 106 beyond a desired maximum tilt angle (e.g., 40 degrees). As can be seen in FIG. 8, the spin ring 104 and the tilt ring 106 limit views into the cavity 806 of the housing 802 from below the lighting fixture 800 when the lamp 202 and the tilt ring 106 are fully tilted as shown in FIG. 8. Further, because the retentions tabs 114, 116 shown in FIG. 1A and the tape 702 shown in FIG. 7 operate in conjunction with the lamp spring 108 to resist detachment of the lamp 202 from the lamp spring 108 when the lamp 202 is pushed from below the change the tilt angle of the lamp 202.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A lighting structure for a light fixture, the lighting structure comprising:

a trim ring;

a spin ring positioned within the trim ring;

a tilt ring positioned within the spin ring and attached to the spin ring by a fastener, wherein the tilt ring is tiltable relative to the spin ring, wherein a first tab and a second tab extend out inwardly from a wall of the tilt ring, the first tab and the second tab positioned across from the fastener; and a lamp spring attached to the tilt ring across from the first tab and the second tab, wherein the lamp spring is positioned to push a lamp toward the first tab and the second tab such that one or both of the first tab and the second tab resist an upward movement of the lamp.

2. The lighting structure of claim 1, wherein the lamp spring is attached to the tilt ring by the fastener.

3. The lighting structure of claim 2, wherein the tilt ring is rotatable along with the spin ring.

4. The lighting structure of claim 1, wherein the lamp spring comprises a first arm and a second arm that extend away from the fastener and wherein the first arm and the second arm are spaced from each other to hold a lamp therebetween.

5. The lighting structure of claim 1, wherein the tilt ring is attached to the spin ring by a second fastener across from the fastener.

6. The lighting structure of claim 5, wherein the first tab and the second tab are on opposite sides of the second fastener.

7. The lighting structure of claim 1, wherein the spin ring is rotatable relative to the trim ring.

8. A light fixture, comprising:

a housing;

a lighting structure positioned in the housing, the lighting structure comprising:

a spin ring;

a tilt ring positioned within the spin ring and attached to the spin ring by a fastener, wherein the tilt ring is tiltable relative to the spin ring, wherein a first tab and a second tab extend out inwardly from a wall of the tilt ring, the first tab and the second tab positioned across from the fastener; and a lamp spring attached to the tilt ring across from the first tab and the second tab; and a lamp extending through the tilt ring, wherein the lamp spring is positioned to push the lamp toward the first tab and the second tab such that one or both of the first tab and the second tab resist an upward movement of the lamp.

9. The lighting fixture of claim 8, wherein the lighting structure further comprises a trim ring, wherein the spin ring is rotatable relative to the trim ring.

10. The lighting fixture of claim 8, wherein the lamp spring is attached to the tilt ring by the fastener.

11. The lighting fixture of claim 8, wherein the lamp spring comprises a first arm and a second arm that extend away from the fastener and wherein the first arm and the second arm are spaced from each other to hold the lamp therebetween.

12. The lighting fixture of claim 8, wherein the tilt ring is attached to the spin ring by a second fastener across from the fastener.

13. A lighting structure for a light fixture, the lighting structure comprising:

a trim ring;

a spin ring positioned within the trim ring; and a tilt ring positioned within the spin ring and attached to the spin ring by a first fastener and a second fastener, wherein the first fastener and the second fastener are across from each other, the tilt ring having a first elevated section and a second elevated section that are between the first fastener and the second fastener and across from each other, wherein the tilt ring includes lower sections between the first elevated section and the second elevated section, wherein the first elevated section and the second elevated section extend higher than the lower sections, wherein the first elevated section and the second elevated section each comprise an extended blocking section.

14. The lighting structure of claim 13, wherein a lamp spring attached to the tilt ring.

15. The lighting structure of claim 13, wherein the spin ring includes a first tall section and a second tall section that are between the first fastener and the second fastener, wherein the first tall section is adjacent to the first elevated section and wherein the second tall section is adjacent to the second elevated section.

16. The lighting structure of claim 15, wherein the spin ring includes short sections between the first tall section and the second tall section, wherein the first tall section and the second tall section extend higher than the short sections.

17. The lighting structure of claim 13, wherein a first bottom edge section of the tilt ring proximal to the second tall section remains below a top edge of the first elevated section when the tilt ring is fully tilted in a first direction such that the first bottom edge section is elevated relative to a second bottom edge section that is diametrically across the tilt ring.

18. The lighting structure of claim 17, wherein a top edge of the first elevated section proximal to the first tall section is aligned with a bottom end section of the spin ring when the tilt ring is fully tilted in the first direction.

19. The lighting structure of claim 13, wherein a height of the first elevated section and a height of the second elevated section gradually increase away from the first fastener and the second fastener.

20. The lighting structure of claim 13, wherein the extended blocking section of each of the first elevated section and the second elevated section is directed inwardly.

* * * * *